US009498730B2

(12) United States Patent
Cai

(10) Patent No.: US 9,498,730 B2
(45) Date of Patent: Nov. 22, 2016

(54) YOYO CAPABLE TO BE MANUALLY ACCELERATED WHEN HELD BY HANDS

(71) Applicants: GUANGDONG ALPHA ANIMATION & CULTURE CO., LTD., Guangdong (CN); GUANGDONG AULDEY ANIMATION & TOY CO., LTD., Guangdong (CN); GUANGZHOU ALPHA CULTURE COMMUNICATIONS CO., LTD., Guangdong (CN)

(72) Inventor: Dongqing Cai, Guangdong (CN)

( * ) Notice: Subject to any disclaimer, the term of this patent is extended or adjusted under 35 U.S.C. 154(b) by 250 days.

(21) Appl. No.: 14/390,792

(22) PCT Filed: Nov. 30, 2013

(86) PCT No.: PCT/CN2013/088244

§ 371 (c)(1),
(2) Date: Oct. 6, 2014

(87) PCT Pub. No.: WO2015/014055

PCT Pub. Date: Feb. 5, 2015

(65) Prior Publication Data

US 2016/0256790 A1 Sep. 8, 2016

(30) Foreign Application Priority Data

Jul. 29, 2013 (CN) ..... 2013 1 0321577

(51) Int. Cl.
*A63H 1/30* (2006.01)
*A63H 29/24* (2006.01)

(52) U.S. Cl.
CPC ..... *A63H 1/30* (2013.01); *A63H 29/24* (2013.01)

(58) Field of Classification Search
USPC ..... 446/236, 242, 246–250, 256
See application file for complete search history.

(56) References Cited

U.S. PATENT DOCUMENTS

| | | | | |
|---|---|---|---|---|
| 5,184,972 | A * | 2/1993 | Tomberlin | A63H 1/30 446/249 |
| 5,984,759 | A * | 11/1999 | O'Sullivan | A63H 1/32 446/250 |
| 7,448,934 | B2 * | 11/2008 | Van Dan Elzen | A63H 1/30 446/236 |
| 7,874,891 | B2 * | 1/2011 | Van Dan Elzen | A63H 1/30 446/236 |
| 8,187,052 | B2 * | 5/2012 | Van Dan Elzen | A63H 1/30 446/247 |
| 8,414,348 | B2 * | 4/2013 | Weems | A63H 1/30 29/426.1 |
| 2004/0198151 | A1 * | 10/2004 | Bell | A63H 1/30 446/247 |
| 2005/0048869 | A1 * | 3/2005 | Osawa | A63H 1/06 446/250 |
| 2007/0032164 | A1 * | 2/2007 | Chow | A63H 1/30 446/249 |
| 2012/0220186 | A1 * | 8/2012 | Choh | A63H 1/30 446/250 |

* cited by examiner

*Primary Examiner* — Kurt Fernstrom
(74) *Attorney, Agent, or Firm* — Prakash Nama; Global IP Services, PLLC

(57) ABSTRACT

A yoyo capable to be manually accelerated when held by hands comprising two spinning bodies (1), a button (2) and a side cap (3) mounted at center positions of outer sides of the two spinning bodies (1) respectively, a manual acceleration mechanism provided inside the two spinning bodies (1) and connecting the two spinning bodies (1) as a whole, and a bearing (4) disposed between the two spinning bodies (1) for winding a yoyo string; two ends of the manual acceleration mechanism are connected with the spinning bodies (1); by pressing the button (2), the manual acceleration mechanism drives the spinning bodies (10) to spin. The yoyo has a wider range of utility satisfying the playing needs of kids and children and at the same time increasing the ways of playing the yoyo and thus the fun in playing the yoyo. Also, the yoyo allows players to create their own ways of playing the yoyo.

10 Claims, 4 Drawing Sheets

YOYO CAPABLE TO BE MANUALLY ACCELERATED WHEN HELD BY HANDS

BACKGROUND OF THE INVENTION

The present invention relates to a yoyo, and more specifically relates to a yoyo capable to be manually accelerated when held by hands.

Due to the constraints of the retracting and bearing systems of a conventional yoyo, a conventional yoyo cannot be played by a short player because length of the yoyo string is proportional to the player's height. When a taller player releases the yoyo, the yoyo is provided with a sufficiently large acceleration zone for the yoyo to accelerate to a spin speed enough for the player to complete different yoyo tricks. However, when a short player releases the yoyo, the acceleration zone is too tiny and thus the yoyo cannot spin with a speed enough to perform yoyo tricks. Nowadays, the market provides a kind of yoyo mounted with side cap bearings. The side cap bearings can spin with respect to the spinning body of the yoyo. Therefore, when the yoyo is thrown by using the yoyo string and then spins in a high speed, players can hold the side cap bearings on the left and right sides so that the yoyo can keep spinning when it is held by hands. However, this kind of design simply enables the yoyo to be additionally played on hands, but still fails to solve the existing problem in a conventional yoyo. In other words, this kind of design cannot accelerate the spin speed of the yoyo when the yoyo is held by hands. Accordingly, short players are still unable to play a conventional yoyo. A conventional yoyo is therefore not well received by kids and children.

BRIEF SUMMARY OF THE INVENTION

In view of the aforesaid disadvantages now present in the prior art, the present invention provides a kind of yoyo capable to be manually accelerated when held by hands. The yoyo according the present invention can provide much fun in playing and can be accelerated when it is being held by hands.

The present invention is attained as follows:

A yoyo capable to be manually accelerated when held by hands comprises two spinning bodies, a button mounted at a center position of an outer side of a first spinning body of the spinning bodies, a side cap provided at a center position of an outer side of a second spinning body of the spinning bodies, a manual acceleration mechanism provided inside the two spinning bodies and connecting the two spinning bodies as a whole, and a bearing disposed between the two spinning bodies for winding a yoyo string; two ends of the manual acceleration mechanism are connected with the spinning bodies; by pressing the button, the manual acceleration mechanism drives the spinning bodies to spin simultaneously.

The manual acceleration mechanism comprises a screw, a spring, a connecting sleeve and a side cap bearing; the screw is connected with the button; the spring sleeves the screw so as to enable the screw and the button to reset their positions after being pressed; the connecting sleeve connects the two spinning bodies as a whole; the screw drives the connecting sleeve to rotate; the side cap bearing is mounted in an inner side of the side cap; an inner bore of the side cap bearing sleeves an end portion of the connecting sleeve.

In order that spin speed of the spinning bodies is accelerated when the button is pressed, and spinning of the spinning bodies will not be affected when the button is released; a control member is provided between the screw and the button; when the button is pressed inwardly, the control member restricts rotation of the screw so that the screw drives the connecting sleeve to rotate when the screw moves inwardly; when the button resets its position outwardly, the control member withdraws its control over the screw so that the screw rotates while moving outwardly.

Further, the control member is formed by a several epicyclic gears around the screw; recesses for accommodating the epicyclic gears are provided in the button; a periphery portion next to one side of each of the recesses is provided with a pit; a top portion of the screw is provided with a top gear engaging correspondingly with the epicyclic gears; when the button is pressed inwardly, the epicyclic gears will be locked in pits after the epicyclic gears have rotated a certain angle, thereby restricting rotation of the screw as the screw moves inwardly.

In view of convenient installation, disassembly and component replacement, the connecting sleeve comprises a wrap-cast screw bolt and a wrap-cast screw nut screwed and connected with each other; the wrap-cast screw bolt is provided with a screw hole through a center portion of the wrap-cast screw bolt matching correspondingly to the screw; the wrap-cast screw bolt is mounted at a center portion of an inner side of the first spinning body disposed with the button, and the wrap-cast screw nut is mounted at a center portion of an inner side of the second spinning body disposed with the side cap; the wrap-cast screw nut extends inside the second spinning body towards an outer side of the second spinning body and inserts into the inner bore of the side cap bearing.

In order that the center of gravity of the yoyo is maintained at the center of the yoyo, ring-shaped counterweights for balancing weights of the two spinning bodies are provided inside cavities of the spinning bodies; decorative caps opened with holes at their centers are provided at outer peripheries of the cavities of the spinning bodies; the button and the side cap extends out of the spinning bodies through the holes of the decorative caps.

The present invention provides a button and a side cap extending out of the outer sides of the center portions of the two spinning bodies, and also provides a manual acceleration mechanism inside the two spinning bodies, whereas two ends of the manual acceleration mechanism are connected to the spinning bodies and the spinning bodies are driven by the manual acceleration mechanism to rotate when the button is pressed. Therefore, when the idle rotation speed of the yoyo is slow, the button can be pressed to accelerate spinning of the yoyo to increase the spinning time of the yoyo so that players are provided with sufficient time to perform more yoyo tricks; alternatively, when the yoyo is not spinning, the button can be pressed repeatedly to start spinning the yoyo, and when the spin speed is high enough, grab the yoyo string and then release the yoyo to perform various yoyo tricks. Accordingly, even a short player can play the yoyo. The yoyo of the present invention has a wider range of utility satisfying the playing needs of kids and children and at the same time increasing the ways of playing the yoyo and thus the fun in playing the yoyo. Further, due to the ring-shaped counterweights provided in the cavities of the spinning bodies while the weights of the counterweights can be decided according to the weight difference between the two halves of the yoyo, weight balance of the two halves of the yoyo can be ensured so as to maintain the center of gravity of the yoyo at the bearing. Accordingly, when the yoyo is driven by the yoyo string to spin, the yoyo can be ensured to spin steadily and also with a longer spinning time. In summary, the yoyo of the present invention has a smart design and provides various ways of playing the yoyo. Players can have much fun in playing the yoyo. The yoyo of the present invention satisfies the playing needs of short players and allows players to create their own ways of playing the yoyo so that the yoyo can remain to be an appealing toy even after a long period of time.

BRIEF DESCRIPTION OF THE DRAWINGS

The present invention is now further described with reference to the accompanying figures.

DETAILED DESCRIPTION OF THE INVENTION

Figure 1:
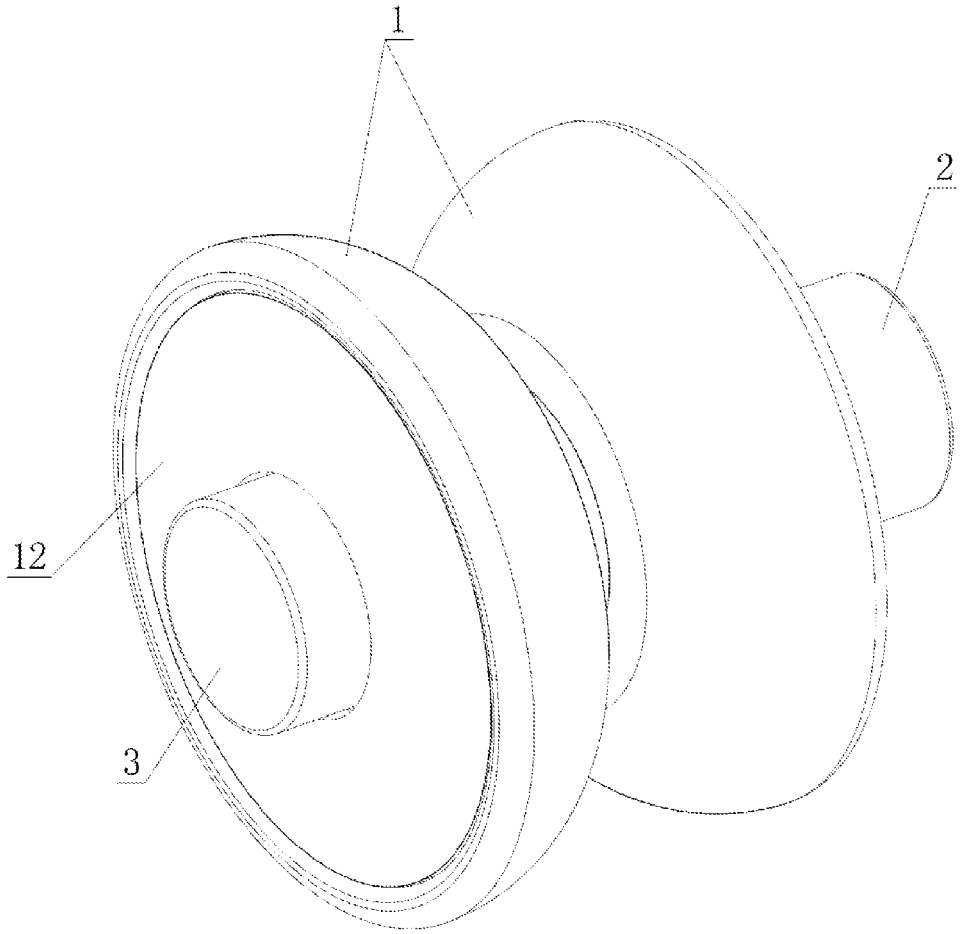
FIG. 1 is a perspective view showing the structure of the present invention.
Figure 2:
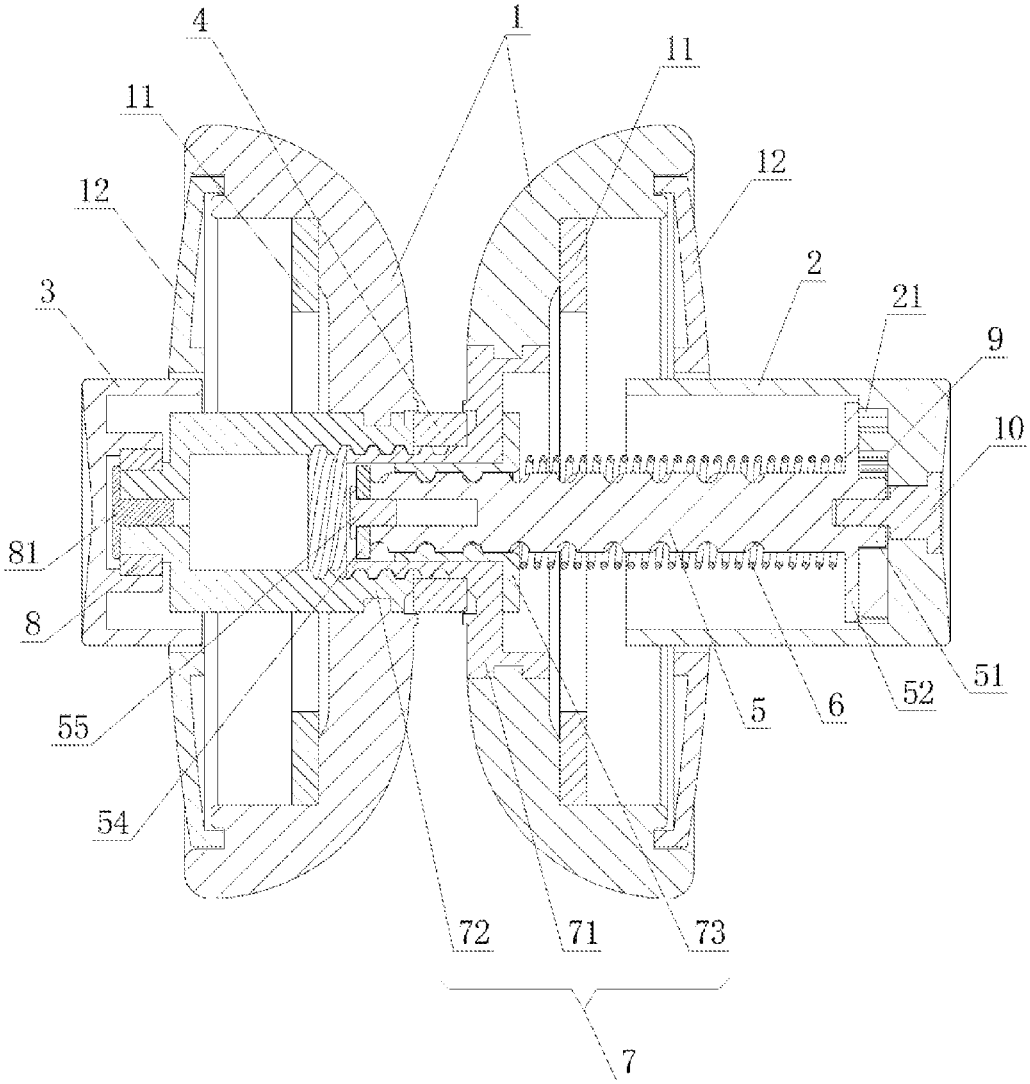
FIG. 2 is a sectional view showing the structure of the present invention.
Figure 3:
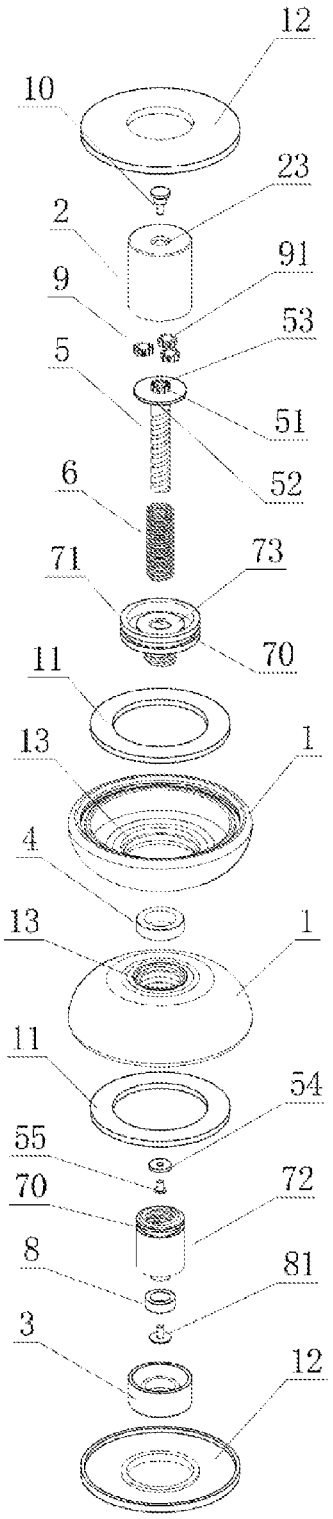
FIG. 3 is an exploded view showing the structure of the present invention.

As shown in FIGS. 1-3, a yoyo capable to be manually accelerated when held by hands comprises two spinning bodies 1, a button 2 mounted at a center position of an outer side of a first spinning body of the spinning bodies 1, a side cap 3 provided at a center position of an outer side of a second spinning body of the spinning bodies 1, a manual acceleration mechanism provided inside the two spinning bodies 1 and connecting the two spinning bodies 1 as a whole, and a bearing 4 disposed between the two spinning bodies 1 for winding a yoyo string. Two ends of the manual acceleration mechanism are connected with the spinning bodies 1. By pressing the button 2, the manual acceleration mechanism drives the spinning bodies 1 to spin. Therefore when idle rotation speed of the yoyo is slow, the button 2 can be pressed to accelerate spinning of the yoyo to increase the spinning time of the yoyo so that players are provided with sufficient time to perform more yoyo tricks; alternatively, when the yoyo is not spinning, the button 2 can be pressed repeatedly to start spinning the yoyo, and when the spin speed is high enough, grab the yoyo string and then release the yoyo to perform various yoyo tricks. Accordingly, even a short player can play the yoyo. The yoyo of the present invention has a wider range of utility satisfying the playing needs of kids and children and at the same time increasing the ways of playing the yoyo and thus the fun in playing the yoyo.

Figure 4:
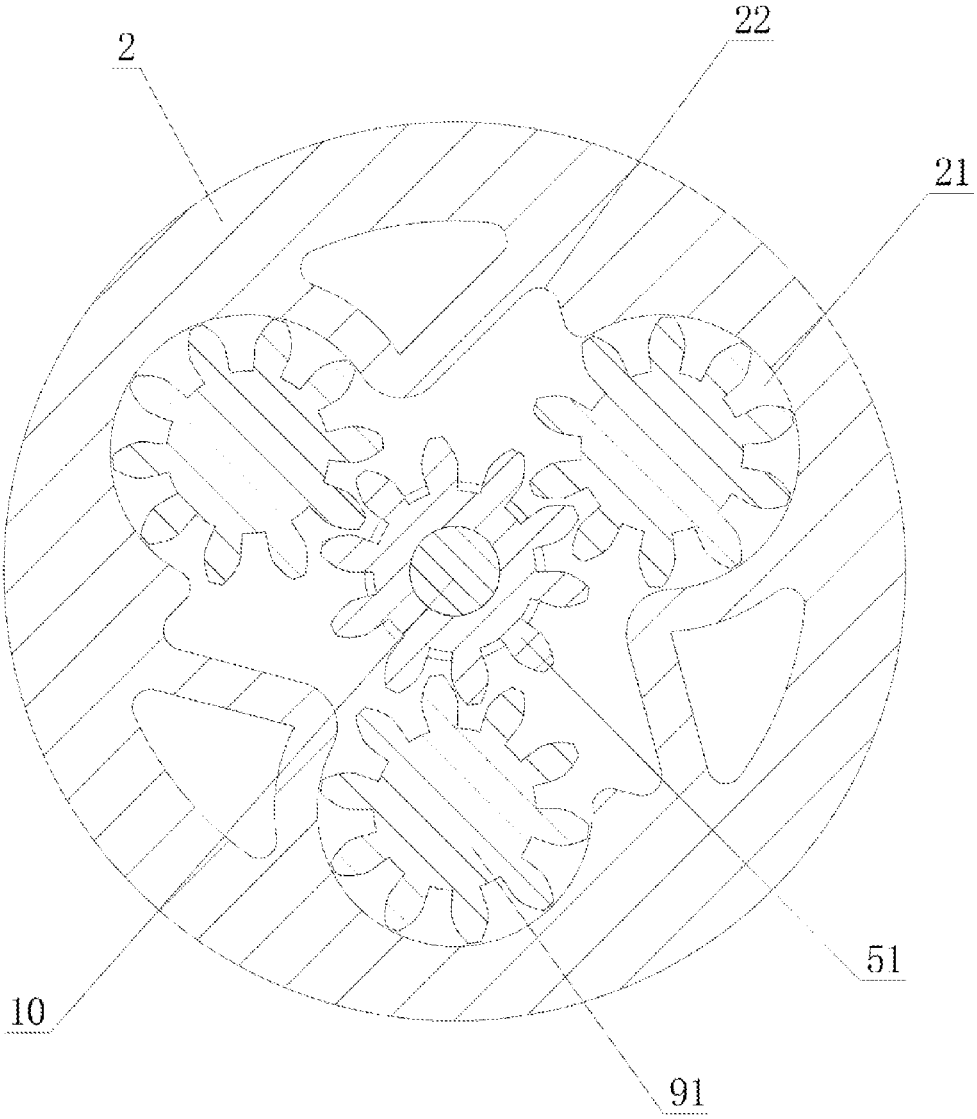
FIG. 4 is a structural view showing the coordination between the button, the epicyclic gears and the screw.

As shown in FIGS. 2-3, the manual acceleration mechanism comprises a screw 5, a spring 6, a connecting sleeve 7 and a side cap bearing 8. The screw 5 is connected with the button 2. The spring 6 sleeves the screw 5 so that the screw 5 and the button 2 can reset their positions after being pressed. The connecting sleeve 7 connects the two spinning bodies 1 as a whole. The screw 5 drives the connecting sleeve 7 to rotate. The side cap bearing 8 is mounted in an inner side of the side cap 3. An inner bore of the side cap bearing 8 sleeves an end portion of the connecting sleeve 7. A control member 9 is provided between the screw 5 and the button 2. When the button 2 is pressed inwardly, the control member 9 restricts rotation of the screw 5 so that the screw 5 drives the connecting sleeve 7 to rotate when the screw 5 moves inwardly. When the button 2 resets its position outwardly, the control member 9 withdraws its control over the screw 5 so that the screw 5 rotates while moving outwardly. In this way, the present invention ensures accelerated spin speed of the spinning bodies 1 when the button 2 is pressed and ensures that spinning of the spinning bodies 1 will not be affected when releasing the button 2 and resetting position of the screw 5. As shown in FIG. 4, the control member 9 is formed by three epicyclic gears 91 around the screw 5. Recesses 21 for accommodating the epicyclic gears 91 are provided in the button 2. A periphery portion next to one side of each of the recesses 21 is provided with a pit 22. The pit 22 is a grooved portion of a respective periphery portion next to a respective recess of the recesses 21. A top portion of the screw 5 is provided with a top gear 51 engaging correspondingly with the epicyclic gears 91. When the button 2 is pressed inwardly, the screw 5 rotates; as the screw rotates 5, the top gear 51 drives the epicyclic gears 91 towards their respective pits; as the epicyclic gears 91 rotate, they displace as well; after the epicyclic gears 91 have rotated a certain angle, teeth of the epicyclic gears 91 will fall into the pits so that the epicyclic gears 91 are locked and the rotation of the screw 5 is restricted; in this case, when the button 2 is pressed, the screw 5 is driven to move inwardly towards the spinning bodies 1 without any rotation. An outwardly extending circular platform 52 is provided on the screw 5 so as to separate the top gear 51 and a lower portion of the screw 5. The circular platform 52 is provided to cover openings of the recesses 21 in an inner side of the button 2 so as to prevent the epicyclic gears 91 from falling out of the recesses 21. The screw 5 has a screw hole 53 opened at a center position at a top surface of the top gear 51. A stepped hole 23 is opened at a center position of the button 2. The screw 5 and the button 2 are fixed as a whole by screwing a stepped screw 10 into the screw hole 53 after passing through the stepped hole 23 of the button 2.

As shown in FIG. 3, the connecting sleeve 7 comprises a wrap-cast screw bolt 71 and a wrap-cast screw nut 72 screwed and connected with each other. The wrap-cast screw bolt 71 can be provided with a screw hole through a center portion of the wrap-cast screw bolt 71 matching correspondingly to the screw 5; alternatively, a circular hole can be provided at the center portion of the wrap-cast screw bolt 71 and a T-shaped insertion tube 73 opened with a screw hole in its middle portion is provided to match correspondingly to the circular hole of the wrap-cast screw bolt 71, and the screw 5 is screwed into the screw hole of the T-shaped insertion tube 73. FIG. 3 adopts the latter configuration. The wrap-cast screw bolt 71 is mounted at a center portion of an inner side of the first spinning body of the spinning bodies 1 disposed with the button 2, and the wrap-cast screw nut 72 is mounted at a center portion of an inner side of the second spinning body of the spinning bodies 1 disposed with the side cap 3; the wrap-cast screw nut 72 extends inside the second spinning body towards an outer side of the second spinning body and inserts into the inner bore of the side cap bearing 8. The wrap-cast screw bolt 71 and the wrap-cast screw nut 72 are provided with mounting grooves 70 at their connecting portions with the spinning bodies 1. The spinning bodies 1 are provided with protruding mounting flanges 13 at their hole opening portions. The wrap-cast screw bolt 71 and the wrap-cast screw nut 72 are tightly connected with the spinning bodies 1 through mutual fittings between the mounting grooves 70 and the mounting flanges 13. Alternatively, the wrap-cast screw bolt 71 and the first spinning body can be formed as a whole by injection molding, and the wrap-cast screw nut 72 and the second spinning body can also be formed as a whole by injection molding. An end portion of the screw 5 extends out of the screw hole of the wrap-cast screw nut 71 and is connected with a gasket 54. The gasket 54 is fixedly connected to the end portion of the screw 5 by using a cap screw 55. Diameter of the gasket 54 is smaller than hole diameter of the screw hole of the wrap-cast screw bolt 71 but bigger than hole diameter of the screw hole of the T-shaped insertion tube 73 so as to prevent the screw 5 from disengaging the wrap-cast screw bolt 71 due to inertia when the screw 5 resets its position. An end portion of the wrap-cast screw nut 72 extending inside the second spinning body towards an outer side of the second spinning body is provided with a protruding column; the protruding column extends into the inner bore of the side cap bearing 8; an end portion of the protruding column is opened with a screw hole; by screwing a washer screw 81 having a screw cap with a diameter bigger than the inner bore of the side cap bearing 8 into the screw hole on the protruding column, the wrap-cast screw nut 72, the side cap bearing 8 and the side cap 3 are connected as a whole. Ring-shaped counterweights 11 are provided inside cavities of the spinning bodies 1; weights of the counterweights 11 can be decided based on the weight difference between the two halves of the yoyo so as to balance the weights of the two halves of the yoyo and maintain the center of gravity of the yoyo at the bearing 4. Accordingly, when the yoyo is driven by the yoyo string to spin, the yoyo can be ensured to spin steadily and also with a longer spinning time. For the purpose of a more pleasant appearance, decorative caps 12 opened with holes at their centers are provided at outer peripheries of the cavities of the spinning bodies 1; insertion slots are provided at peripheries of the spinning bodies 1; the decorative caps 12 are fixed into the insertion slots of the spinning bodies 1 by means of ultrasonic so as to fix the decorative caps 12 onto the spinning bodies 1; the button 2 and the side cap 3 extends out of the spinning bodies 1 through the holes of the decorative caps 12 so that they can be grabbed by fingers.

The operation principle of the yoyo capable to be manually accelerated when held by hands is described as follows:

Use two fingers to grab the button 2 and the side cap 3 at the left and right sides of the yoyo; press the button 2 so that the top gear 51 of the screw 5 engages with the epicyclic gears 91 to rotate the epicyclic gears 91; after the epicyclic gears 91 have rotated a certain angle, they are locked in the pits 22 inside the button 2 so that the button 2, the screw 5 and the epicyclic gears 91 move inwardly to the spinning bodies 1 as a whole without any rotation; the spring 6 is then compressed and the wrap-cast screw bolt 71 will rotate in a direction opposite to the screw 5 due to frictional force; the wrap-cast screw nut 72 follows the wrap-cast screw bolt 71 to rotate and the whole yoyo is driven to rotate. Repeat the above steps to accelerate the spin speed of the yoyo. When the yoyo is accelerated up to a desired spin speed, release the button 2; the button 2 and the screw 5 will reset their positions due to the resilience of the spring 6 while the yoyo will continue to spin due to inertia; players can then throw the yoyo to perform various yoyo tricks.

The present invention described with reference to the above embodiments should not be limited by the embodiments. Any changes to the embodiments obvious to a person skilled in this field of art should fall within the scope of protection defined by the claims of the present invention.

What is claimed is:

1. A yoyo capable to be manually accelerated when held by hands comprises two spinning bodies (1), a button (2) mounted at a center position of an outer side of a first spinning body of the spinning bodies (1), a side cap (3) provided at a center position of an outer side of a second spinning body of the spinning bodies (1), a manual acceleration mechanism provided inside the two spinning bodies (1) and connecting the two spinning bodies (1) as a whole, and a bearing (4) disposed between the two spinning bodies (1) for winding a yoyo string; two ends of the manual acceleration mechanism are connected with the spinning bodies (1); by pressing the button (2), the manual acceleration mechanism drives the spinning bodies (1) to spin simultaneously.

2. The yoyo capable to be manually accelerated when held by hands as in claim 1, wherein the manual acceleration mechanism comprises a screw (5), a spring (6), a connecting sleeve (7) and a side cap bearing (8); the screw (5) is connected with the button (2); the spring (6) sleeves the screw (5) so as to enable the screw (5) and the button (2) to reset their positions after being pressed; the connecting sleeve (7) connects the two spinning bodies (1) as a whole; the screw (5) drives the connecting sleeve (7) to rotate; the side cap bearing (8) is mounted in an inner side of the side cap (3); an inner bore of the side cap bearing (8) sleeves an end portion of the connecting sleeve (7).

3. The yoyo capable to be manually accelerated when held by hands as in claim 2, wherein a control member (9) is provided between the screw (5) and the button (2); when the button (2) is pressed inwardly, the control member (9) restricts rotation of the screw (5) so that the screw (5) drives the connecting sleeve (7) to rotate when the screw (5) moves inwardly; when the button (2) resets its position outwardly, the control member (9) withdraws its control over the screw (5) so that the screw (5) rotates while moving outwardly.

4. The yoyo capable to be manually accelerated when held by hands as in claim 3, wherein the control member (9) is formed by several epicyclic gears (91) around the screw (5); recesses (21) for accommodating the epicyclic gears (91) are provided in the button (2); a periphery portion next to one side of each of the recesses (21) is provided with a pit (22); a top portion of the screw (5) is provided with a top gear (51) engaging correspondingly with the epicyclic gears (91); when the button (2) is pressed inwardly, the epicyclic gears (91) will be locked in pits after the epicyclic gears (91) have rotated a certain angle, thereby restricting rotation of the screw (5) as the screw (5) moves inwardly.

5. The yoyo capable to be manually accelerated when held by hands as in claim 4, wherein an outwardly extending circular platform (52) is provided on the screw (5) so as to separate the top gear (51) and a lower portion of the screw (5); the circular platform (52) is provided to cover openings of the recesses (21) in an inner side of the button (2) so as to prevent the epicyclic gears (91) from falling out of the recesses (21).

6. The yoyo capable to be manually accelerated when held by hands as in claim 5, wherein the screw (5) has a screw hole (53) opened at a center position of a top surface of the top gear (51); a stepped hole (23) is opened at a center position of the button (2); the screw (5) and the button (2) are fixed as a whole by screwing a stepped screw (10) into the screw hole (53) after passing through the stepped hole (23) of the button (2).

7. The yoyo capable to be manually accelerated when held by hands as in claim 2, wherein the connecting sleeve (7) comprises a wrap-cast screw bolt (71) and a wrap-cast screw nut (72) screwed and connected with each other; the wrap-cast screw bolt (71) is provided with a screw hole through a center portion of the wrap-cast screw bolt (71) matching correspondingly to the screw (5); the wrap-cast screw bolt (71) is mounted at a center portion of an inner side of the first spinning body disposed with the button (2), and the wrap-cast screw nut (72) is mounted at a center portion of an inner side of the second spinning body disposed with the side cap (3); the wrap-cast screw nut (72) extends inside the second spinning body towards an outer side of the second spinning body and inserts into the inner bore of the side cap bearing (8).

8. The yoyo capable to be manually accelerated when held by hands as in claim 7, wherein an end portion of the screw (5) extends out of the screw hole of the wrap-cast screw nut (71) and is connected with a gasket (54); the gasket (54) is fixedly connected to the end portion of the screw (5) by using a cap screw (55).

9. The yoyo capable to be manually accelerated when held by hands as in claim 7, wherein an end portion of the wrap-cast screw nut (72) extending inside the second spinning body towards an outer side of the second spinning body is provided with a protruding column; the protruding column extends into the inner bore of the side cap bearing (8); an end portion of the protruding column is opened with a screw hole; by screwing a washer screw (81) having a screw cap with a diameter bigger than the inner bore of the side cap bearing (8) into the screw hole on the protruding column, the wrap-cast screw nut (72), the side cap bearing (8) and the side cap (3) are connected as a whole.

10. The yoyo capable to be manually accelerated when held by hands as in claim 1, wherein ring-shaped counterweights (11) for balancing weights of the two spinning bodies (1) are provided inside cavities of the spinning bodies (1);

decorative caps (12) opened with holes at their centers are provided at outer peripheries of the cavities of the spinning bodies (1); the button (2) and the side cap (3) extends out of the spinning bodies (1) through the holes of the decorative caps (12).

* * * * *